US006286378B1

(12) United States Patent
Kamei et al.

(10) Patent No.: US 6,286,378 B1
(45) Date of Patent: Sep. 11, 2001

(54) STARTER

(75) Inventors: Koichiro Kamei; Shigeru Shiroyama; Akira Kuragaki; Hidekazu Katayama, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/442,328

(22) Filed: Nov. 17, 1999

(30) Foreign Application Priority Data

Jun. 7, 1999 (JP) ..... 11-159495

(51) Int. Cl.[7] ..... F02N 15/06

(52) U.S. Cl. ..... 74/7 A; 74/7 C; 74/7 E; 335/131

(58) Field of Search ..... 74/7 A, 7 C, 7 E; 290/38 R, 38 A, 38 C, 48; 335/131

(56) References Cited

U.S. PATENT DOCUMENTS 5,839,318 * 11/1998 Kimura et al. ..... 74/7 R
5,901,604 * 5/1999 Sato et al. ..... 74/7 A

FOREIGN PATENT DOCUMENTS 2 710 696 4/1995 (FR) .
1-7962 3/1989 (JP) ..... H01H/50/20
10-159693 6/1998 (JP) ..... F02N/11/00

* cited by examiner

*Primary Examiner*—Allan D. Herrmann
(74) *Attorney, Agent, or Firm*—Sughrue, Mion, Zinn, Macpeak & Seas, PLLC

(57) ABSTRACT

To reduce abrasion of the pinion and the ring gear, a coil spring and a plate are arranged between the inner circumference of the plunger and the output shaft. The plate is adapted to the rear end of the thrust spline of the overrunning clutch to transmit the elastic force of the coil spring to the thrust spline.

4 Claims, 10 Drawing Sheets

FORWARD
BACKWARD
A
Z
M
X
Y
20t
1t
60e
20
51
50
3
3w
52
54
50e
3Pe
53
3P
60d
3e
3c
3y
1
3B
3r
3A
3b
1a
70c
2c
3a
2
9v
2b
4t
3x
5b
2t
2a
23
9d
6
1y
17b
9c
16
1x
8
4
17a
7s
5a
7t
1F
7
17
1h
18
30
18c
17h
1z
17c
34
35
70b
31
1P
18a
15h
11
18b
15
33
10a
10b
15a
11a
14
32
9b
9a
70a
11t
13
13a
12
40
16e
60a
41

STARTER

BACKGROUND OF THE INVENTION

1. Field of the Invention

The present invention relates to a starter for starting an engine.

2. Description of the Prior Art

FIG. 9 is a sectional view showing an example of a conventional starter disclosed in Japanese Published Unexamined Patent Application No. 10-159693-1998.

In FIG. 9, 1A is an output shaft. An electromagnetic switch 2A, an over-running clutch 30A provided with a pinion 30P which meshes with a ring gear 50A, a plunger 40A comprising an inner plunger 4A and an outer plunger 4B, etc. are arranged coaxially on this output shaft 1A. A starter with this structure is generally called a coaxial type starter. 12A is an armature of a DC electric motor and 16A is a shaft (a motor shaft). 18A is a reduction mechanism which reduces the rotational force of the shaft 16A and transmits it to the output shaft 1A.

8A is a contact shaft supported by an inner gear member 17A of the reduction mechanism 18A almost parallel with the plunger 40A through a supporting hole 17*m*.

100 is a bracket and 800 is a shift plate which connects the outer plunger 4B with the contact shaft 8A.

The upper portion from the central axis in FIG. 9 shows the state of a starter not in operation and the lower portion shows the state wherein the starter is in operation with an electromagnetic switch turned ON and the pinion meshed with the ring gear.

Next, the operation of the starter is explained. The operation will be explained referring also to FIG. 10, which is a partially enlarged view of FIG. 9.

First, when an ignition switch is turned ON and current flows to an exciting coil 2B of the electromagnetic switch 2A, the outer plunger 4B is attracted by the exciting core 2C of the electromagnetic switch 2A. This conventional starter has such a structure that the outer plunger 4B is directly connected with the contact shaft 8A via the shift plate 800. When the outer plate 4B is attracted by the exciting coil 2B, the contact shaft 8A is also moved simultaneously. Between the outer plunger 4B and the inner plunger 4A, there is a coil spring 401 mounted via a spring bracket 400. The inner plunger 4A is kept in the stationary state because the coil spring 401 bends at the initial stage even when the outer plunger 4B is attracted and begins to move. In front of the inner plunger 4A, an inner clutch 30B is mounted via a shifter member 402 and as long as the inner plunger 4A is kept in the stationary state, the inner clutch 30B is also kept in the stationary state. After a short interval when the plunger 4B is attracted and begins to move, a movable contact 80A mounted on the contact shaft 8A comes into contact with a stationary contact 80B mounted in the contact chamber ZA. When the movable contact 80A is brought into contact with the stationary contact 80B, electric power is supplied from an external power source via a contact bolt 11A and an armature 12A begins to turn. When the output shaft 1A begins to turn by way of the reduction mechanism 18A, the pinion 30P is caused to move toward the ring gear 50A by a thrust generated in a helical spline portion 1B, and the threads and the thread grooves of the pinion 30P and the ring gear 50A agree and mesh. Thereafter, when the engine starts, the output shaft 1A and the pinion 30P are separated by the action of the overrunning clutch 30A and the pinion runs idle. When the power supply to the exciting coil 2B is stopped, the pinion 30P is disengaged from the ring gear 50A by return springs 403, 404.

However, in the case of a conventional starter disclosed in Japanese Published Unexamined Patent Application No. 10-159693-1998, the outer plunger 4B is directly connected with the contact shaft 8A by the shift plate 800. The contact shaft 8A also moves simultaneously with the attraction and movement of the outer plunger 4B and therefore, the movable contact 80A immediately comes into contact with the stationary contact 80B and the armature 12A begins to rotate before the end surface 30Pe of the pinion 30P comes into contact with the end surface 50Ae of the ring gear 50A.

That is, according to the above conventional starter, the pinion 30P meshes with the ring gear 50A by rotating the pinion 30P by driving the armature 12. However, in the above starter, the thrust generated in the helical spline portion 1B is insufficient to press the pinion 30P toward the ring gear 50A and the coil spring 401 is also incapable of pressing the pinion 30P toward the ring gear 50A. Therefore, when meshing with the ring gear 50A, the pinion 30P is often repelled by the ring gear 50A and tries again to mesh with it.

Accordingly, the pinion 30P does not mesh with the ring gear 50A smoothly and reliability when the pinion 30P meshes inadequately with the ring gear 50A. In addition, the gears are worn away and the life span of the gears is shortened.

In the case of a starter with a structure wherein the contact shaft moves by the same amount as the outer plunger as in the above starter, it is required to secure a moving space for a plate (an engaging ring, etc.) to hold the coil spring 9S for pressing the contact shaft and the movable contact in the contact chamber and, as a result, the contact chamber inevitably becomes large.

SUMMARY OF THE INVENTION

The present invention was made to solve such problems as those mentioned above and its object is to provide a starter which is capable of meshing the pinion with the ring gear more smoothly than before, so that the pinion meshes with the ring gear in an excellent manner, reducing abrasion of the gears and thus, extending the life of the gears.

Another object is to provide a starter that is capable of more smoothly meshing the pinion with the ring gear, downsizing the starter.

In the starter of the present invention, an elastic means and a transmission means are provided between the inner circumference of the plunger and the outer circumference of the output shaft, and the transmission means is adapted to contact the rear end of the thrust spline to transmit an elastic force of the elastic means to the thrust spline, and wherein a pressing means is fixedly secured to the inner circumference of the rear side of the plunger to press the elastic means and move the over-running clutch toward the ring gear via the elastic means, the transmission means and the thrust spline, the pressing means being further arranged to cause the pinion to mesh with the ring gear by the elastic force of the elastic means when the top and bottom of the pinion agree those of the ring gear after the end surface of the pinion contacts the end surface of the ring gear.

A contact shaft moving means is provided to move the contact shaft in such a direction as to cause the movable contact to contact the stationary contact after the plunger is attracted and moved for a certain time by the exciting coil.

The above and other objects, features and advantages of the present invention will become more apparent from the following description when taken in conjunction with the accompanying drawings.

DESCRIPTION OF THE PREFERRED EMBODIMENTS

[First Embodiment]

A first embodiment of a starter of the present invention will be described below referring to the attached drawings.

Figure 1:
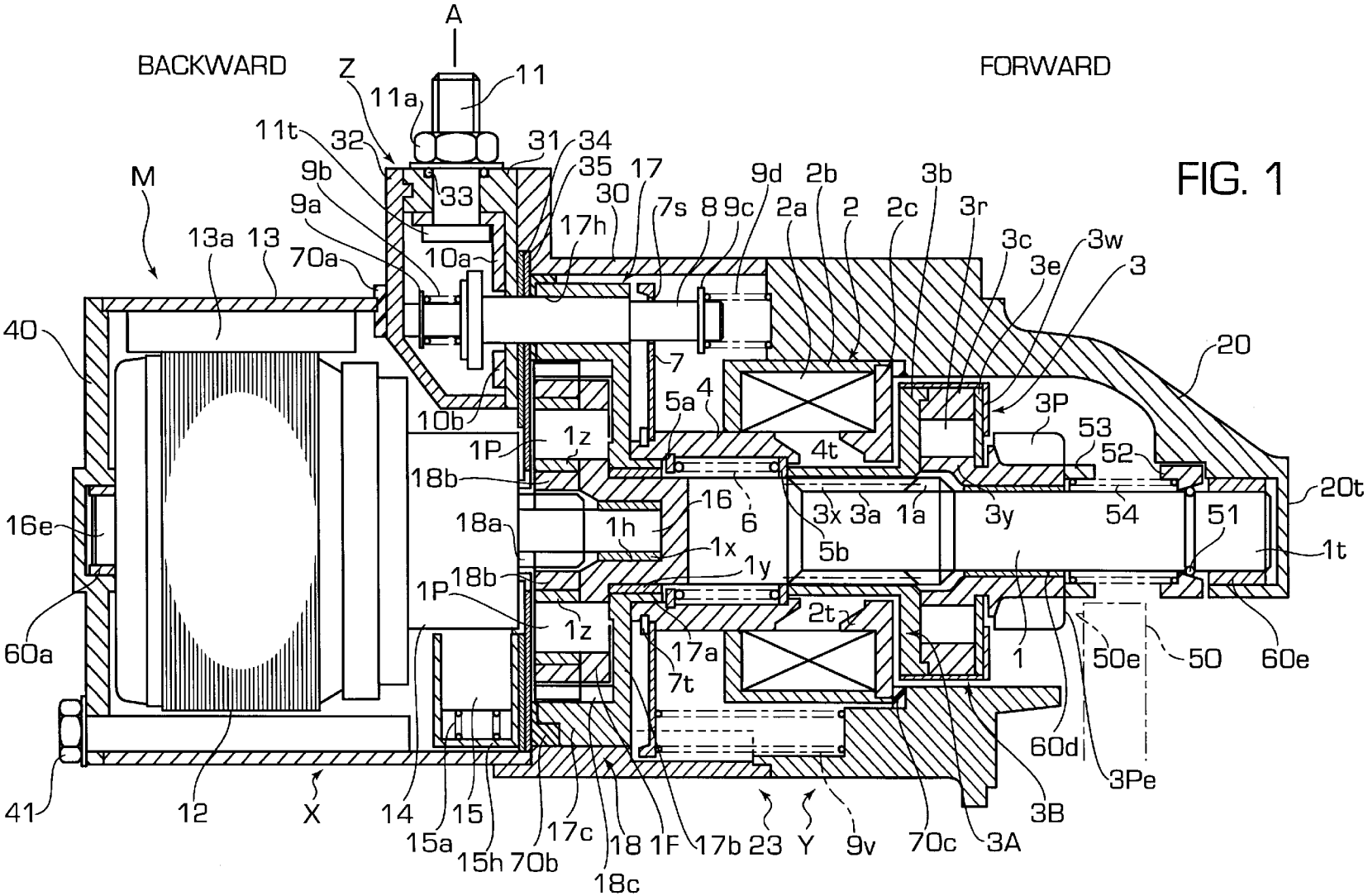
FIG. 1 is a sectional view showing the structure of a starter according to a first embodiment of the present invention.

FIG. 1 is a sectional view showing the structure of a starter in the embodiment 1.

The starter in the first embodiment is covered by such outer wall members as a front bracket 20, a central bracket 30, and a rear bracket 40 and presents a nearly bullet-shaped external appearance. A portion in which a ring gear 50 is located is an opening.

In the starter, there are arranged a DC motor M and an output shaft 1 that is driven by this DC motor M. Around the output shaft 1, a ring-shaped electromagnetic switch 2, an over-running clutch 3, and a plunger (a movable core 4) are arranged.

In other words, the starter according to this first embodiment is a coaxial type starter with the electromagnetic switch 2, the over-running clutch 3 and the plunger 4 coaxially arranged on the output shaft 1.

The structure of the starter according to this first embodiment will be described below in detail.

In FIG. 1, the left side portion is a DC motor portion X, the right side portion is an operating portion Y and the upper side of the central portion is a contact chamber Z. The electric motor side in FIG. 1 is referred to as the rear and the ring gear side is referred to as the front in the following explanation.

As is well known, the DC motor M comprises an armature 12, a yoke 13 that covers this armature 12, a stationary magnetic pole 13*a* provided inside this yoke 13, a commutator 14, brushes 15 and a shaft 16. The armature 12 is an armature core with an armature coil wound round it. The front side of the shaft 16 penetrates the cylindrical space of the cylindrical commutator 14 and is connected to a reduction mechanism 18.

The armature coil is connected to the commutator 14. The DC motor M is available in 2-pole, 4-pole and 6-pole types depending on the number of stationary magnetic poles. For instance, taking the case of using a 6-pole DC motor as a sample, a total of 6 units of the stationary magnetic pole 13*a* are provided by arranging a N-pole and a S-pole alternately. The brushes 15 kept in contact with the commutator 14 are arranged along the circumference of the commutator 14.

15*a* is a spring that pushes the brush 15 against the commutator 14. 15*h* is a brush holder.

The output shaft 1 is driven by the DC motor M as described above.

The operating portion Y comprises the reduction mechanism 18, the output shaft 1, the electromagnetic switch 2, the overrunning clutch 3, and the plunger 4.

17 is an inner gear member. This member comprises a first tubular portion 17*a* which is fitted to the outer circumference of the output shaft 1 via a bearing ly, a hollow disk shape bottom plate portion 17*b* which extends in the direction perpendicular to the outer circumference of the output shaft 1 from the first tubular portion 17*a*, and a second tubular portion 17*c* that has an inner gear 18*c* on the inner circumference.

The reduction mechanism 18 comprises the inner gear 18*c* of the inner gear member 17, a sun gear 18*a* provided on the shaft 16, a plurality of planet gears 18*b* arranged around this sun gear 18*a* engaging with the sun gear 18*a* and the inner gear 18*c*, and a pin 1P that projects from a flange 1F of the output shaft 1 inserted between the group of planet gears 18*b* and a bottom plate 17*b* of the inner gear member 17 and connects each of the planet gears 18*b* to the flange 1F of the output shaft 1. Further, the rotational force of each planet gear 18*b* is transmitted to each pin 1P via a bearing 1*z*.

A round groove 1*h* is formed at the center of the flange 1F of the output shaft 1 and the forward end of the shaft 16 is supported rotatably via a bearing 1*x* provided in the round groove 1*h*.

Figure 3:
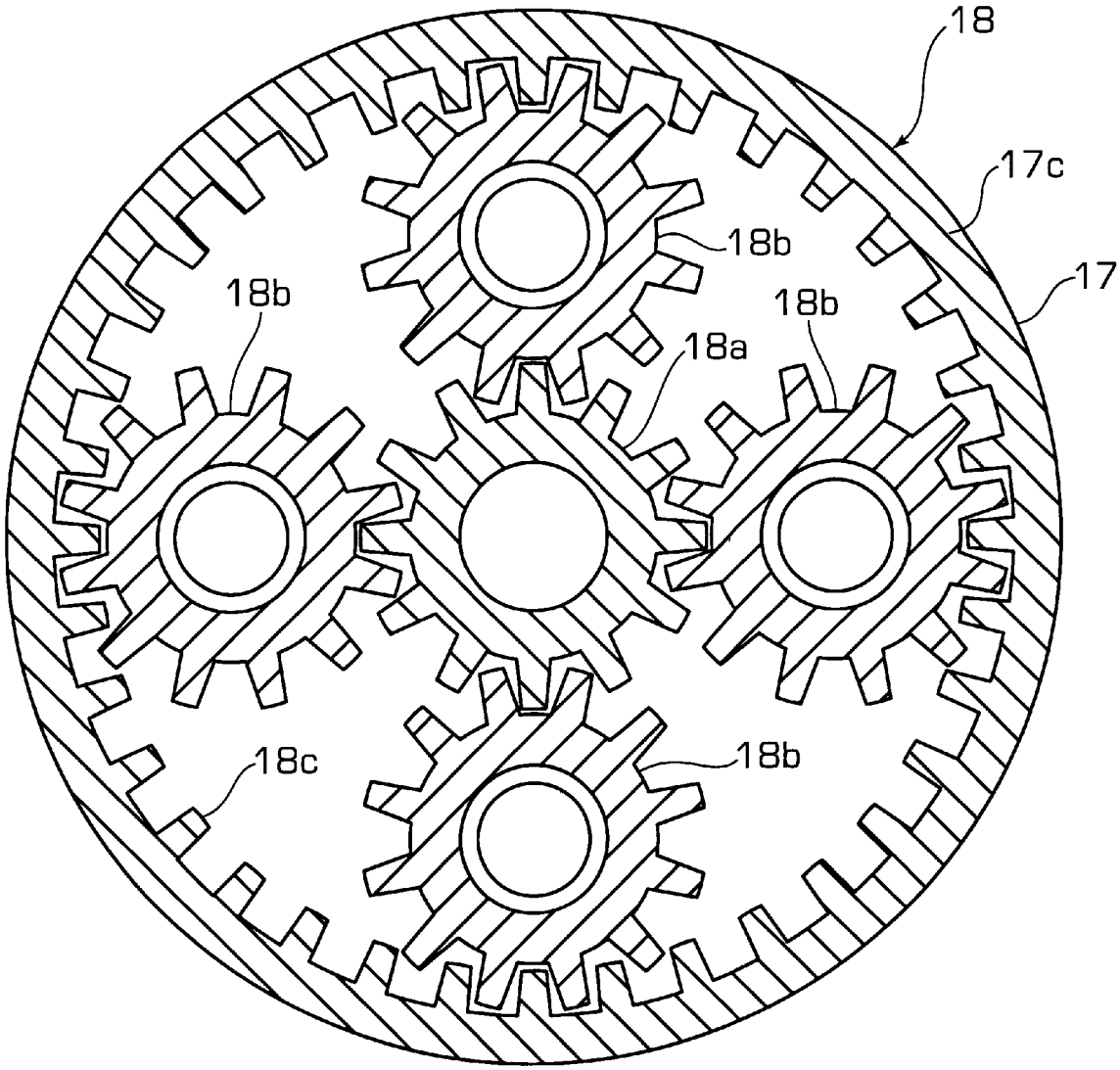
FIG. 3 is a sectional view of a reduction mechanism.

Accordingly, as shown in the sectional view in FIG. 3, when the planet gears 18*b* move round the sun gear 18*a*, the rotational force of the shaft 16 is reduced and transmitted to the output shaft 1 through the pins 1P.

A helical spline 1*a* is formed on a part of the outer circumference at the central side of the output shaft 1. On the outer circumference of the part where this helical spline 1*a* is formed, the overrunning clutch 3 is arranged so that a tubular portion 3*a* of a thrust spline 3A corresponds thereto. Further, on the inner surface of the tubular portion 3*a* of the thrust spline 3A, ahelical spline 3*x* is formed to mesh with the helical spline 1*a*. That is, the overrunning clutch 3 is spline-connected to the output shaft 1.

The electromagnetic switch 2 is arranged on the outer circumference of the tubular portion 3*a* of the thrust spline 3A.

The plunger 4 is arranged on the outer circumference at the flange 1F side of the output shaft 1.

The over-running clutch 3 comprises the thrust spline 3A that is formed of the tubular portion 3*a* having the helical spline 3*x* formed on the inner surface for meshing with the helical spline 1*a* that is formed on a part of the outer circumference at the central side of the output shaft 1, the flange portion 3*b* that is provided at the front side of this tubular portion 3*a* and becomes the cam bottom of a roller cam that is described later, a roller cam 3*c* interposed between the flange portion 3*b* of this thrust spline 3A and a washer 3*e*, a pinion 3P, an inner clutch 3*y* composed of a tubular portion at the base of the pinion 3P, a clutch roller 3*r* and a spring 3*s* that are arranged in a groove 3*t* formed on the roller cam 3*c*, and a clutch cover 3*w* that covers the outside of the flange portion 3*b* of the thrust spline 3A, the roller cam 3*c* and the washer 3*e*.

The thrust spline 3A and the roller cam 3*c* comprise an outer clutch 3B.

Figure 4:
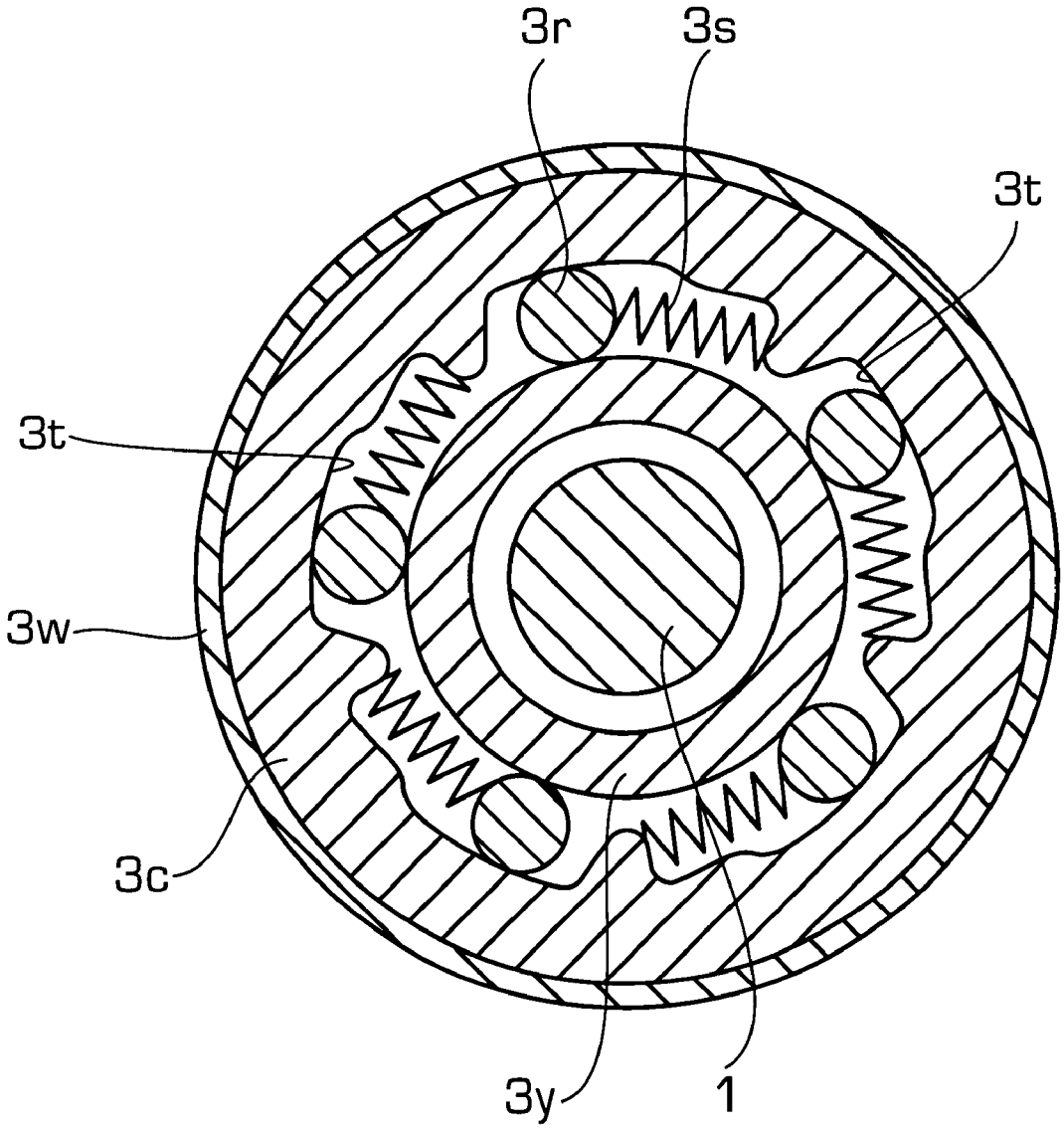
FIG. 4 is a sectional view of an over-running clutch.

The over-running clutch 3 acts as a so-called one-way clutch. The sectional view of the over-running clutch is shown in FIG. 4. At several points on the inner circumference of the roller cam 3*c*, grooves 3*t* are provided to form a narrow space and a wide space between the outer circumference of the inner clutch 3*y*. The clutch roller 3*r* is arranged in each of these grooves 3*t*. 3*s* is a spring for pressing the clutch roller 3*r* toward the narrow space of the groove 3*t*.

When the output shaft 1 is driven by the DC motor M, the roller cam 3*c* is rotated, the clutch roller 3*r* moves to the narrow space of the groove 3*t*, the roller cam 3*c* of the outer clutch 3B meshes with the inner clutch 3*y*, and the pinion 3P turns and meshes with the ring gear 50. Then, when the pinion 3P is rotated together with the ring gear 50, the clutch roller 3*r* moves to the wide space of the groove 3*t*, the outer clutch 3B and the inner clutch 3*y* are disengaged, and the over-running clutch 3 protects the power transmitted from the engine.

The electromagnetic switch 2 comprises the exciting coil 2*a*, a switch case for covering the exciting coil 2*a* and a core 2*c*, and is arranged at the rear side of the position of the over-running clutch 3. The core 2*c* has a hollow shaped disc surface opposing the flange portion 3*b* of the thrust spline 3A and is made in the ring shaped body arranged so as to penetrate the outer circumference of the tubular portion 3*a* of the thrust spline 3A. The core 2*c* also has a ring shaped projecting portion 2*t* that extends to the rear side at the tubular portion 3*a* side of the thrust spline 3A.

The plunger 4 is made of a tubular body that is arranged in a movable manner between the inner circumference of the switch case 2*b* and the tubular portion 3*a* of the thrust spline 3A. The front end 4*t* opposing the ring shaped projecting portion 2*t* is formed in a shape corresponding to the shape of the ring shaped projecting portion 2*t*.

A ring shape plate 5*a* is secured on the inner circumference at the rear end side of the plunger 4.

In addition, a ring shape plate 5*b* is also provided on the rear end side of the tubular portion 3*a* of the thrust spline 3A of the over-running clutch 3.

Between these plates 5*a*, 5*b*, a coil spring 6 is arranged as an elastic means.

That is, the plates 5*a*, 5*b* and the coil spring 6 are provided between the inner circumference of the plunger 4 and the outer circumference of the output shaft 1.

The plate 5*b* as the transmission means is kept in contact with the rear end 3*f* of the thrust spline 3A and transmits the elastic force of the coil spring 6 to the thrust spline 3A.

The ring-shaped plate 5*a* compresses the coil spring 6 and moves the over-running clutch 3 toward the ring gear 50 via this coil spring 6, the plate 5*b* and the thrust spline 3A, and when the gear threads and grooves of the pinion 3P agree with those of the ring gear 50 after the end surface of the pinion 3P is brought into contact with the end surface of the ring gear 50, meshes the pinion 3P with the ring gear 50 by the elastic force of the coil spring 6.

Accordingly, the plunger 4 is attracted by the core 2*c* and moves in the direction (forward) of the core 2*c* and the over-running clutch moves as pushed by the plate 5*b* with the movement of the plunger 4. When the pinion 3P once stops moving after the end surface of the pinion 3P is brought into contact with the end surface of the ring gear 50, the motor is driven and the gear threads fit the grooves of the pinion 3P. The pinion 3P meshes with the ring gear 50 by the elastic force of the coil spring 6 that is compressed and accumulated up to this point. 8 is a contact shaft supported in a movable manner in the extended direction of the shaft by a supporting hole 17*h* provided on a part (the upper part in FIG. 1) of a second tubular portion 17*c* of the inner gear member 17. Further, the contact shaft 8 is mounted so as to extend over the operating portion Y and the contact chamber Z via the supporting hole 17*h*.

At the one end side in the contact chamber Z of the contact shaft 8, a movable contact 8*e* is provided. At the rear side from this movable contact 8*e*, a ring shape plate 9*a* is secured to the contact shaft 8. Between this plate 9*a* and the movable contact 8*e*, there is provided a coil spring 9*b* for pressing the movable contact 8*e* to the stationary contact side (later described). At the other end of the shaft positioned at the operation position Y side of the contact shaft 8, a ring shape plate 9*c* is secured to the contact shaft 8. Between this plate 9*c* and a front bracket 20, a return coil spring 9*d* is provided.

A shift plate 7 is mounted on the rear end of the plunger 4. This shift plate 7 is a slender plate extending in the upper and lower directions with a hole formed at the center for mounting on the rear end of the plunger 4 and a through hole 7*s* at the upper portion corresponding to the contact shaft 8. This shift plate 7 is secured to the plunger 4 with an engaging ring 7*t*. Further, a return coil spring 9*v* is provided between the lower part of the shift plate 7 and the front bracket 20.

The shift plate 7 secured to the plunger 4 and the plate 9*c* which is a plate contacting portion comprise a contact shaft moving means.

The motor portion X, the contact chamber Z and the operating portion Y are divided by parting plates 34, 35.

The contact chamber Z is divided into a contact chamber wall 31 and a contact chamber cover 32. A first stationary contact 10*a* and a second stationary contact 10*b* are provided on the contact chamber wall 31.

The first stationary contact 10*a* is connected to a battery via a terminal volt 11. The second stationary contact 10*b* is connected to the positive pole brushes via a lead wire and is also connected to the other end of the exciting coil 2*a* of the electromagnetic switch 2.

The terminal bolt 11 is secured with a nut 11*a* and the first stationary contact 10*a* is secured to the contact chamber wall 31 by a bolt head 11*t*.

33 is an O-ring and 70*b*, 70*c* are packing. 70*a* is a grommet that is made of rubber or the like as a buffer material, and the contact chamber cover 32 is pressed toward the contact chamber wall 31 by the yoke 13 via this grommet 70*a*.

A rear end 16*e* of the shaft 16 is supported rotatably on a rear bracket 40 via a bearing 60*a*. A front end lt of the output shaft 1 is supported on the side of an end 20*t* of the front bracket 20 via a bearing 60*e*.

At the front side of the output shaft 1, a stopper 52 is provided via an engaging ring 51. Also, at the end of the pinion 3P, a stopper 53 is provided. Between these stoppers 52, 53, a return coil spring 54 is provided.

41 is a bolt for securing the DC motor portion X and the operating portion Y by interposing them between the rear bracket 40 and the front bracket 20.

Figure 5:
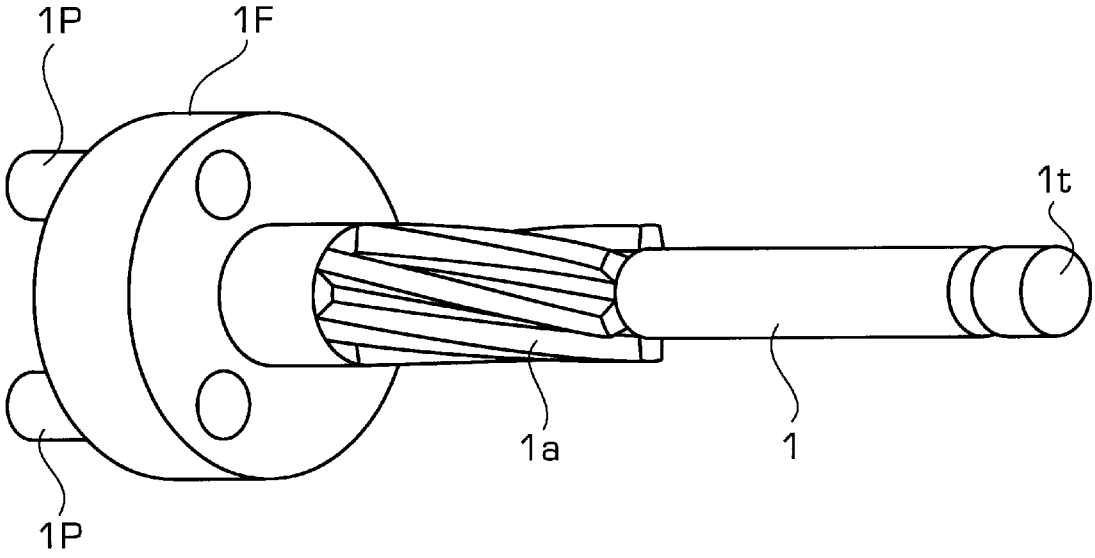
FIG. 5 is a perspective view of an output shaft.
Figure 6A:
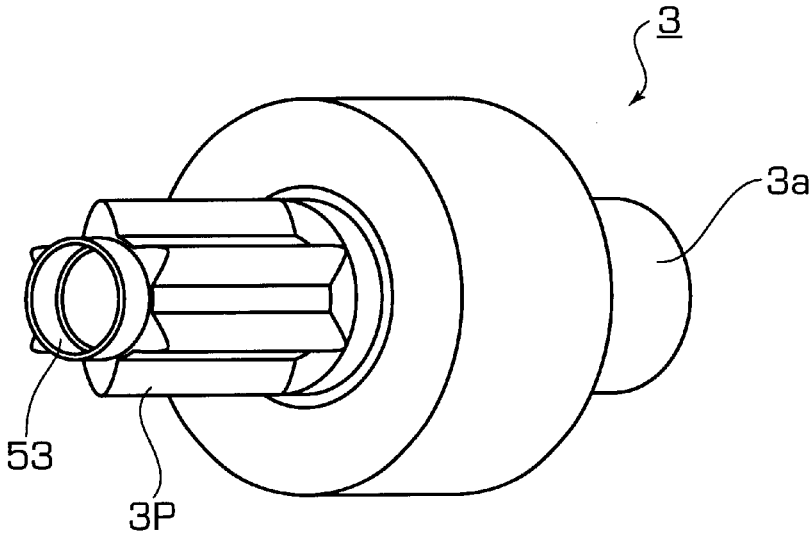
FIG. 6 (*a*) FIG. 6 (*b*) are perspective views of the over-running clutch.
Figure 6B:
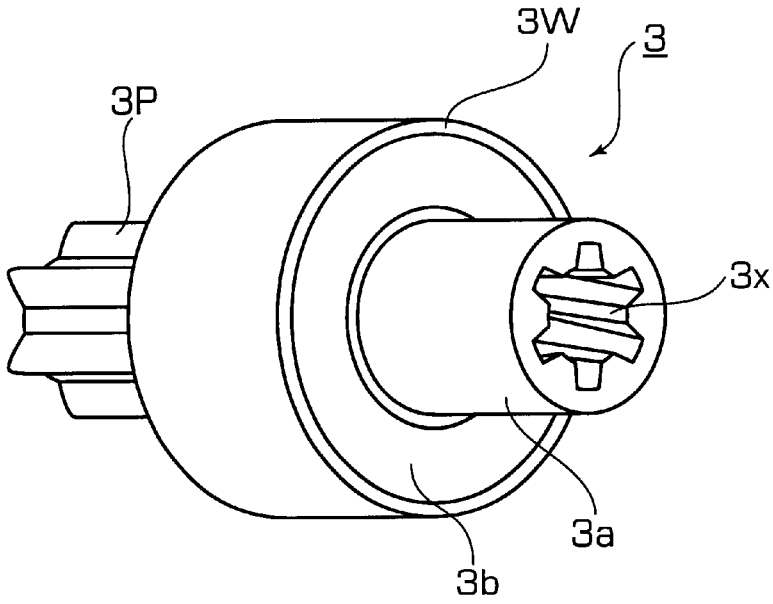
Figure 7:
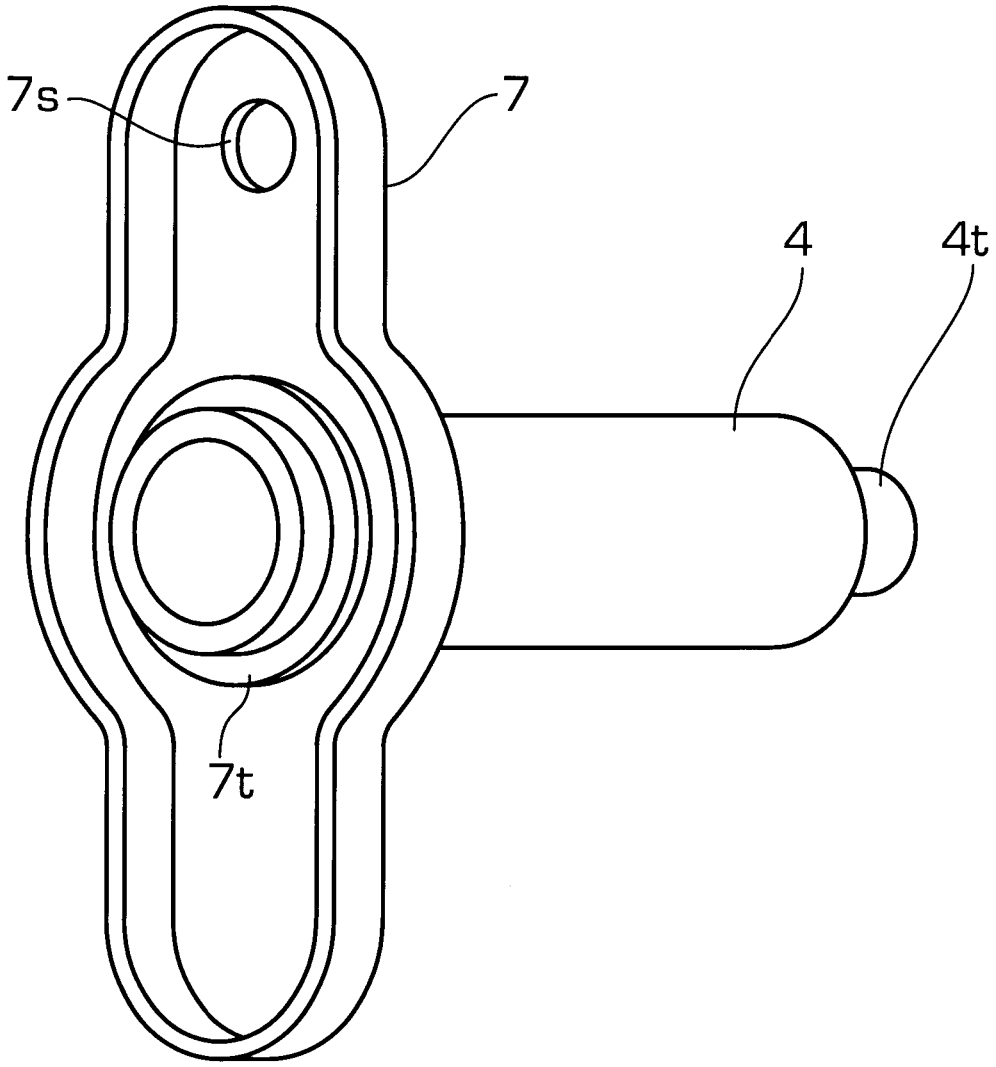
FIG. 7 is a perspective view of a plunger and a shift plate.

FIG. 5 is a perspective view of the output shaft 1, FIG. 6(*a*) and (*b*) show perspective views of the over-running clutch 3, and FIG. 7 shows a perspective view of the plunger 4 and the shift plate 7.

Next, the operation will be described.

Figure 2:
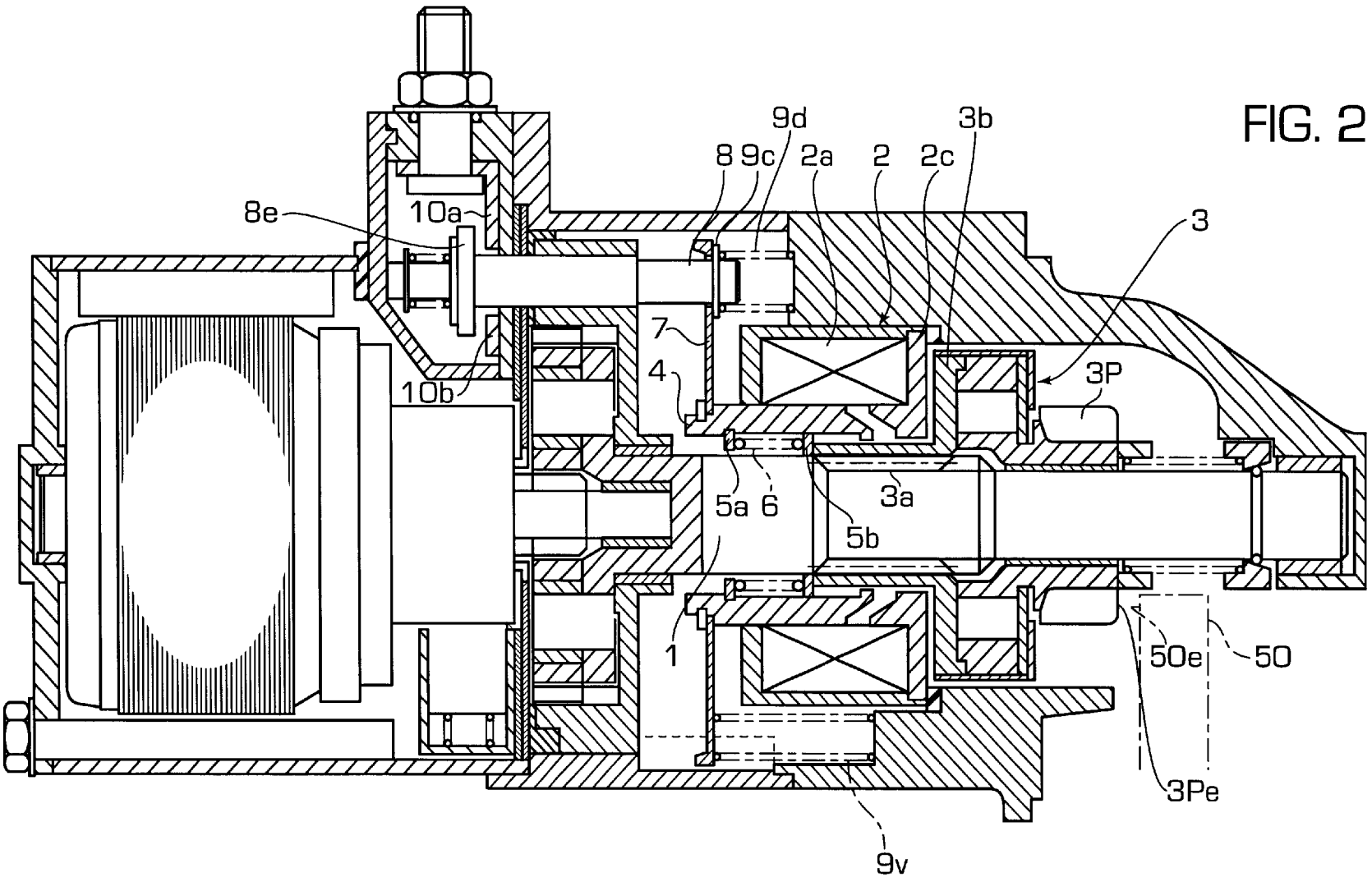
FIG. 2 is a sectional view for explaining the operation of the starter according to the first embodiment.

When the ignition switch is turned ON and current flows to the exciting coil 2*a* of the electromagnetic switch 2, the plunger 4 is attracted toward the exciting core 2*c*, the plate 5*a* pushes the coil spring 6, the plate 5*b* presses the thrust spline 3A, and the over-running clutch 3 is pushed out toward the ring gear 50 as shown in FIG. 2. As a result, the end surface 3Pe of the pinion 3P provided at the overrunning clutch 3 is brought into contact with the end surface 50*e* of the ring gear 50 and the over-running clutch 3 initially stops to move in the forward direction. However, while the plate 5*a* provided at the inner circumference side of the plunger 4 compresses the coil spring 6, the plunger is further attracted and moves continuously. The shift plate 7 also moves forward and contacts the plate 9*c*. Further, FIG. 2 shows the state of the shift plate 7 at the moment when it contacts the plate 9*c*.

After the state shown in FIG. 2, the plunger 4 is continuously attracted and the plate 9*c* secured to the contact shaft 8 is pushed by the shift plate 7 so that the contact shaft 8 also moves forward. Then, when the movable contact 8*e* of the contact shaft 8 is brought into contact with the first and the second stationary contacts 10*a*, 10*b*, electric power is supplied from a battery and the armature 12 begins to rotate.

The contact shaft 8 moves continuously until the plunger 4 is completely attracted and its side of the end 4*t* is brought into contact with the exciting core 2*c*. At this time, the coil spring 9*b* is compressed by the plate 9*a* and thus, the movable contact 8*e* is pressed and kept in contact with the first and the second stationary contacts 10*a*, 10*b*.

When the armature 12 begins to rotate, its rotational force is decelerated via the reduction mechanism 18 and is transmitted to the output shaft 1, the over-running clutch 3 that is spline connected to the output shaft and, further, to the pinion 3P. Then, when the pinion 3P turns slowly and the threads and grooves of the pinion 3P agree with those of the ring gear, the pinion 3P is pushed forward by the spring force (the elastic force) of the compressed coil spring 6 and completely meshes with the ring gear 50. Thus, as the crankshaft connected the ring gear turns, the engine is started.

When the engine is started, the output shaft 1 and the pinion 3P are separated by the action of the over-running clutch 3 and the pinion 3P runs idle. Then, when the power supply to the exciting coil 2*a* is stopped, the pinion 3P is disengaged from the ring gear 50 as the plunger 4 and the over-running clutch 3 are returned to their original positions by the return coil springs 9*d*, 9*v*.

When the top and bottom of the pinion 3P agree with those of the ring gear 50, the end surface 3Pe of the pinion 3P is not brought in contact with the end surface 50*e* of the ring gear 50 but the pinion 3P meshes with the ring gear without any problem.

According to the first embodiment, before the armature 12 is rotated, the end surface 3Pe of the pinion 3P is kept in contact with the end surface 50*e* of the ring gear 50 by the elastic force of the coil spring 6 and then the armature 12 is rotated and the pinion 3P is meshed with the ring gear 50 by the elastic force of the coil spring. Therefore, the pinion 3P is no longer repelled.

Accordingly, when meshing with the ring gear 50, the pinion 3P can be smoothly engaged with the ring gear 50 without being repelled and trying to mesh again with the ring gear 50, and they can mesh smoothly. Therefore, reliability when meshing the pinion 3P and the ring gear 50 becomes excellent so that abrasion of the gears can be reduced and the life span of the gears can be extended.

Because the amount of movement of the contact shaft 8 is reduced less than that of the plunger 4, it becomes possible to make the contact chamber Z small. In other words, a starter can be provided small-sized.

That is, in the case of a structure wherein the contact shaft moves in the same amount as the plunger as in a conventional starter, when the armature is rotated after maintaining the pinion in contact with the ring gear as in the embodiment 1, a large space must be provided between the movable contact and the stationary contact. Also, when considering the moving space for the plate (an engaging ring, etc.) required for holding a spring compressing the movable contact, the contact chamber inevitably becomes large in the structure of a conventional starter.

According to the starter with the structure in this first embodiment, in addition to the effects as described above, the amount of motion of the contact shaft 8 can be reduced, the contact chamber Z can be made small, and as a result, a small-sized starter can be provided.

In the first embodiment, after the plunger 4 is attracted and moved by the contact shaft moving means (the shift plate 7, the plate 9) for a certain time, the contact shaft 8 is moved in the direction to bring the movable contact 8*e* into contact with the stationary contacts 10*a*, 10*b*. However, the shift plate 7 may be directly connected to the contact shaft 8 so that the contact shaft 8 is moved together with the plunger 4. In this case, the plates 5*a*, 5*b* and the coil spring 6 are provided between the inner circumference of the plunger 4and the outer circumference of the output shaft 1 so as to keep the pinion 3P in contact with the ring gear 50 and therefore, when meshing with the ring gear 50, the pinion 3P will no longer be repelled and try again to mesh. Thus, the pinion P3 can mesh with the ring gear 50 more smoothly than before. Therefore, reliability when meshing the pinion 3P with the ring gear 50 becomes excellent, abrasion of the gears is reduced and the life span of the gears can be extended.

The various springs described above may be made of rubber. In short, elastic means capable of conserving elastic force are acceptable.

In the first embodiment, the contact shaft 8 is supported by the supporting hole 17*h* provided on the inner gear member 17. A supporting portion with a supporting hole formed for supporting the contact shaft 8 may be provided on a center bracket 30, which is an outer wall member, and the contact shaft 8 may be supported by the center bracket 30.

Figure 8:
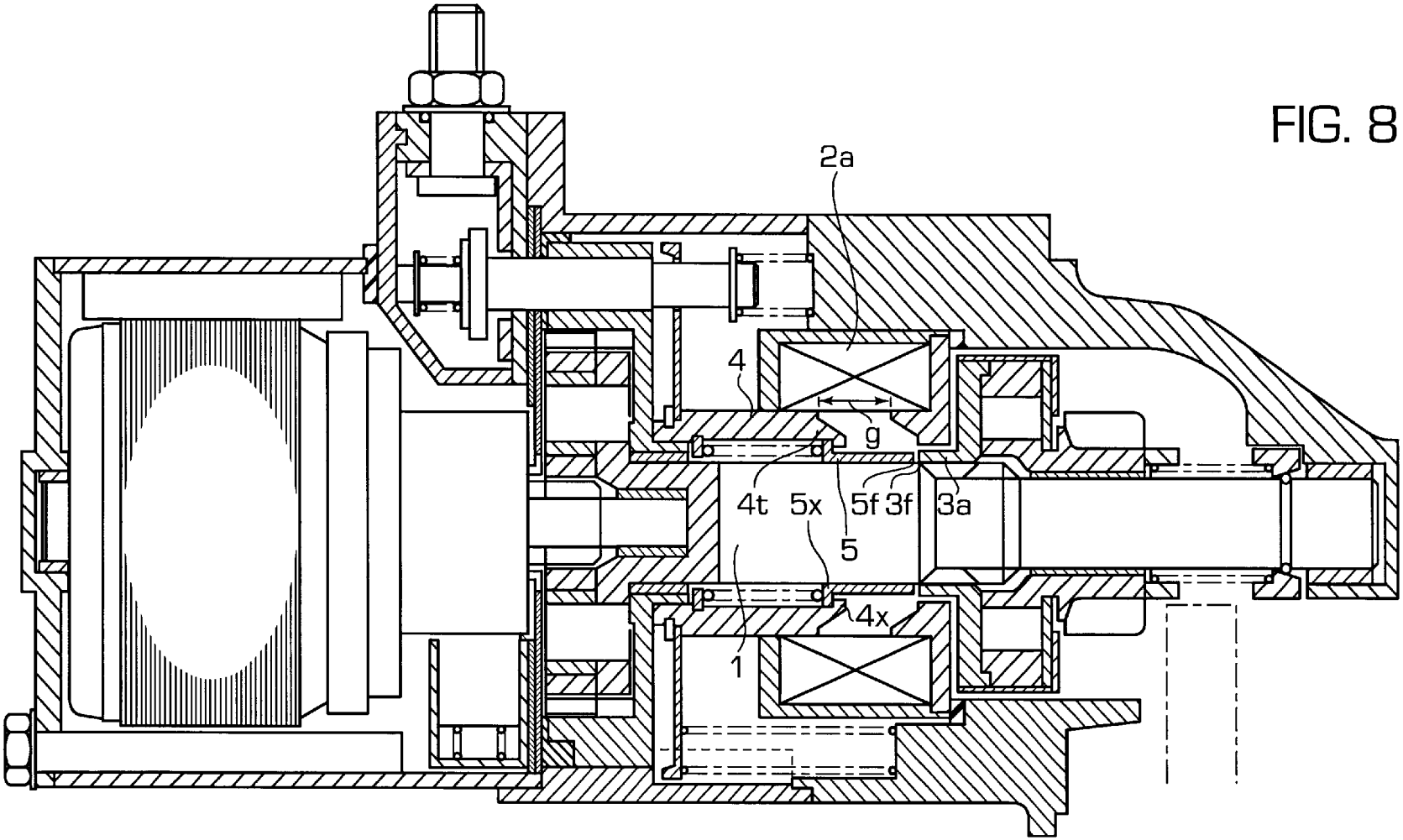
FIG. 8 is a sectional view showing another embodiment of the present invention.
Figure 9:
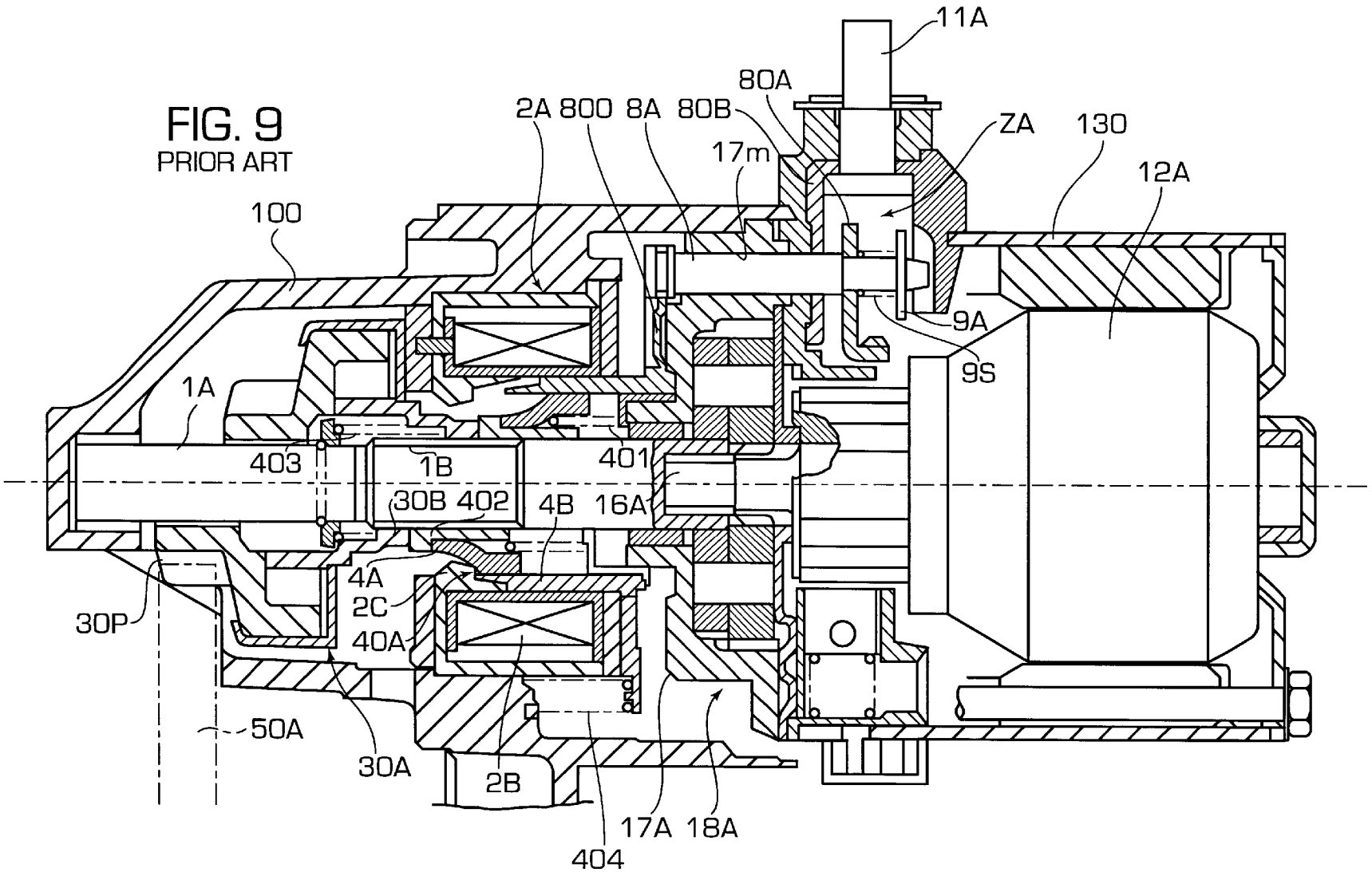
FIG. 9 PRIOR ART
FIG. 9 is a sectional view showing an example of a conventional starter.
Figure 10:
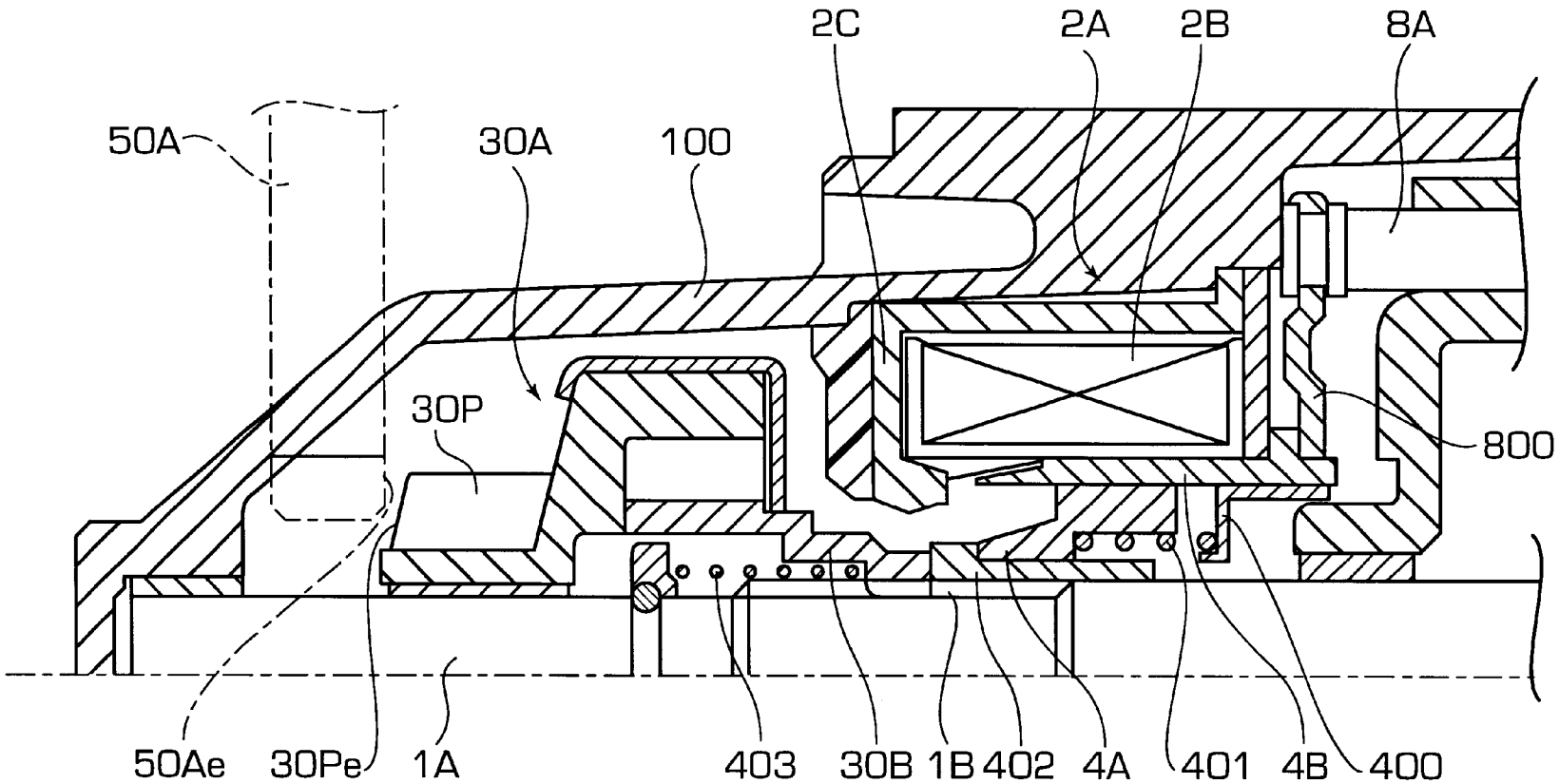
FIG. 10 PRIOR ART
FIG. 10 is a partially enlarged view of FIG. 9.

A tubular body 5 shown in FIG. 8 may be used instead of the plate 5*b*.

In this case, a first engaging portion 4*x* projecting toward the output shaft 1 is to be formed on the end 4*t* of the plunger 4 and a second engaging portion 5*x* that engages the first engaging portion 4*x* is to be formed at the other end of the tubular body 5. Then, the tubular body 5 is provided in the state wherein its one end 5*f* is maintained in contact with one end 3*f* of the thrust spline 3A and the other end is kept engaged with the first engaging portion 4*x* by the second engaging portion 5*x*.

The over-running clutch 3 is arranged so that the rear end 3*f* of the tubular portion 3*a* of the thrust spline 3A is positioned at a specified space between the exciting core 2*c* and the end 4*t* of the opposing plunger 4.

A tubular body made of non-magnetic or low permeability material is used for the tubular body 5 to cover the outer circumference of the output shaft 1 corresponding to the specified space g. Thus, when the exciting coil 2*a* is excited, magnetic flux that leaks to the output shaft 1 and the thrust spline 3*a* can be reduced and the attracting force to the plunger 4 can be improved.

According to the present invention, the elastic means, the transmission means and the pressing means are provided between the inner circumference of the plunger and the outer circumference of the output shaft and it is therefore possible to obtain a starter capable of meshing the pinion with the ring gear more smoothly than before, giving excellent reliability when meshing the pinion with the ring gear, reducing abrasion of the gears and extending the life span of the gears.

In addition, the contact shaft moving means provided makes it possible to mesh the pinion with the ring gear more smoothly and further, to provide a small-sized starter.

The movable contact of the contact shaft is brought into contact with the stationary contact by the action of the contact shaft moving means after the end surface of the pinion has contacted the end surface of the ring gear, the pinion is no longer repelled when meshing with the ring gear and try to again mesh, and the effects described above can be further improved.

What is claimed is:

1. A starter comprising:

an output shaft driven by an electric motor; and a plunger, an exciting coil, and an over-running clutch coaxially arranged on the output shaft, the exciting coil being excitable to attract the plunger so that the motor can be driven, the over-running clutch having a thrust spline spline-connected to the output shaft and being movable in an axial direction to a position in which a pinion of the over-running clutch meshes with a ring gear;

wherein elastic means and transmission means are disposed between the inner circumference of the plunger and the outer circumference of the output shaft, the transmission means contacting the rear end of the thrust spline to transmit an elastic force of the elastic means to the thrust spline;

wherein pressing means is fixedly secured to the inner circumference of the rear side of the plunger, the pressing means (1) pressing the elastic means and moving the over-running clutch toward the ring gear via the elastic means, the transmission means, and the thrust spline, and (2) causing the pinion to mesh with the ring gear by the elastic force of the elastic means after the end surface of the pinion contacts the end surface of the ring gear.

2. A starter according to claim 1, wherein a contact shaft and a contact shaft moving means are provided, wherein the contact shaft has at one end thereof a movable contact for contacting a stationary contact to supply the motor with electric power and is arranged substantially parallel to the plunger, and the contact shaft moving means is arranged to move the contact shaft in such a direction as to cause the movable contact to contact the stationary contact after the plunger is attracted and moved by the exciting coil for a certain time.

3. A starter according to claim 2, wherein the contact shaft moving means comprises a shift plate and a shift plate contacting portion, wherein the shift plate is fixedly secured to the plunger and provided with a through-hole through which the other end of the contact shaft is slidable, and the shift plate contacting portion is provided at the other side of the contact shaft and arranged to contact the shift plate when the shift plate moves for the certain time with the attracting movement of the plunger and move the contact shaft by the movement of the shift plate with further attracting movement of the plunger, thereby causing the movable contact to contact the stationary contact.

4. A starter according to claim 2, wherein the contact shaft moving means causes the movable contact of the contact shaft to contact the stationary contact after the end surface of the pinion contacts that of the ring gear with the attracting movement of the plunger for a certain time.

* * * * *